US008815789B2

(12) United States Patent
Tétard et al.

(10) Patent No.: US 8,815,789 B2
(45) Date of Patent: Aug. 26, 2014

(54) METAL BLEACH CATALYSTS

(75) Inventors: David Tétard, Stanley (GB); Adam Phillip Robinson-Miller, Newcastle upon Tyne (GB); Robert Richard Dykstra, West Chester, OH (US); Gregory Scot Miracle, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 164 days.

(21) Appl. No.: 13/443,923

(22) Filed: Apr. 11, 2012

(65) Prior Publication Data

US 2012/0260433 A1 Oct. 18, 2012

Related U.S. Application Data

(60) Provisional application No. 61/474,480, filed on Apr. 12, 2011.

(51) Int. Cl.

| | |
|---|---|
| ***C11D 3/28*** | (2006.01) |
| ***C11D 3/39*** | (2006.01) |
| ***C11D 7/32*** | (2006.01) |

(52) U.S. Cl.

CPC ..... *C11D 3/28* (2013.01); *C11D 3/3905* (2013.01); *C11D 3/391* (2013.01); *C11D 3/392* (2013.01); *C11D 7/3281* (2013.01)

USPC ..... 510/311; 510/376; 510/500; 510/505; 502/200; 502/324; 502/325

(58) Field of Classification Search

CPC ..... C11D 3/28; C11D 3/3905; C11D 3/391; C11D 3/392; C11D 7/3281; B01J 27/24; B01J 23/34; B01J 23/745

USPC ..... 510/311, 376, 500, 505; 502/200, 324, 502/325; 8/111, 137

See application file for complete search history.

(56) References Cited

U.S. PATENT DOCUMENTS

| | | | | |
|---|---|---|---|---|
| 5,051,523 | A | 9/1991 | Peter et al. | |
| 2004/0198626 | A1 | 10/2004 | Reinhardt et al. | |
| 2005/0009207 | A1 * | 1/2005 | Vos et al. | 438/1 |

FOREIGN PATENT DOCUMENTS

| | | | |
|---|---|---|---|
| DE | 4320308 | A1 | 12/1993 |
| GB | 2117766 | A | 10/1983 |

OTHER PUBLICATIONS

XP002679801; Hsieh, Wen-Zuan et al. ; "Synthesis, Characterization, and Structures of Mn (DMHP) 3. 12H20 and Mn (DMHP) 2C1.0.5H20" Inorganic Chemistry, American Chemical Society, vol. 44, No. 6; Feb. 22, 2005.

XP002679802; Lu, Zai-Sheng et al.; "solubilities of iron (III) complexes of 3-hydroxy-2-ethyl-4-pyranone and of 3-hydroxy-1,2-dimethyl-4-pyridinone in aqueous salt solutions". Transition Metal Chemestry, Kluwer Academic Publishers; vol. 27, No. 3, pp. 239-243, Jan. 1, 2002.

Search Report, 11 Pages, Jul. 2012.

* cited by examiner

*Primary Examiner* — Gregory R Delcotto

(74) *Attorney, Agent, or Firm* — Gregory S. Darley-Emerson; Steven W. Miller

(57) ABSTRACT

Metal bleach catalysts that are complexes of a transition-metal and a dioxo ligand, cleaning compositions comprising such metal bleach catalysts, and methods of using such metal bleach catalysts, are described herein.

10 Claims, No Drawings

METAL BLEACH CATALYSTS

CROSS-REFERENCE TO RELATED APPLICATIONS

This application claims priority under 35 U.S.C. §119(e) to U.S. Provisional Application Ser. No. 61/474,480, filed Apr. 12, 2011.

FIELD OF THE INVENTION

The present invention relates to catalytic systems and methods for oxidizing materials and bleaching stains. More specifically, the present invention relates to the catalytic oxidation of oxidizable compounds using metal bleach catalysts, including synthetic organic oxidation reactions, as appropriate to 1) the chemical process industry, drug synthesis, and the preparation of specialty chemicals; 2) the oxidation of oxidizable compounds (e.g., visible and invisible stains) on surfaces such as fabrics, dishes, countertops, dentures and the like; 3) the oxidation of oxidizable compounds in solution; 4) dye transfer inhibition in the laundering of fabrics; 5) the decontamination of soils; 6) removal of undesirable contaminants from wastewater; and 7) to the bleaching of pulp and paper.

BACKGROUND OF INVENTION

Oxygen bleaching agents continue to be popular in household and personal care products to facilitate stain and soil removal. Bleaches are particularly desirable for their stain-removing, dingy fabric cleanup, whitening and sanitization properties, as well as dye transfer inhibition during and even after the wash and drying process. Oxygen bleaches however are somewhat limited in their effectiveness, because of their extreme temperature rate dependence. Thus, the colder the solution in which they are employed, the less effective the bleaching action. Temperatures in excess of 60° C. are typically required for effectiveness of an oxygen bleaching agent in solution.

For effective bleaching at lower temperatures with hydrogen peroxide, the hydrogen peroxide must be converted into a species having more bleaching activity. One possibility for generating activated peroxy compounds is the use of peracid precursors, so-called "bleach activators" such as TAED and/or NOBS, that are converted by perhydrolysis into the active species.

It is also known to use bleach catalysts to generate activated species, wherein a "bleach catalyst" is understood to be a substance that can improve the bleaching performance of hydrogen peroxide or other peroxygen compounds on a bleachable material without itself participating as a stoichiometric reagent in the reaction. The use of bleach catalysts has the advantage, as compared with the other bleach activation methods, in that sub-stoichiometric quantities of the compound are sufficient, with the result that space and weight can be saved in the formulation of the bleach-containing product. Accordingly, metal bleach catalysts are useful for employment in cleaning compositions utilized for bleaching oxidizable substrates, including stains in solution and on surfaces such as fabric, dishes, countertops, dentures and the like.

However, certain metal bleach catalysts still have shortcomings; for example, they can react too rapidly with hydrogen peroxide, leading to non-productive turnover of available oxygen and reduced bleaching performance. Therefore the pursuit continues for improved metal bleach catalysts, such as those with lower catalyst cost and improved starting material sustainability, as well as better stain selectivity and performance. Accordingly, there is continued interest in identifying and improving metal bleach catalysts.

SUMMARY OF INVENTION

Surprisingly, transition-metal catalysts having the specific dioxo ligands detailed herein have been found to possess an exceptional ability to catalyze bleaching at low temperature, demonstrate improved performance compared to metal bleach catalysts that do not contain a dioxo ligand, and are effective for use in laundry and hard-surface cleaning products. Accordingly, the present disclosure relates to dioxo ligands and dioxo ligand-metal complexes and to the use thereof as metal bleach catalysts.

The present disclosure further relates to compositions and methods for oxidizing materials in the presence of dioxo ligands and/or dioxo ligand-metal complexes transition metals (e.g., Mn). In certain embodiments of the compositions and methods detailed herein, the dioxo ligands are heteroatom-containing dioxo ligands. More specifically, certain embodiments of compositions and methods detailed herein may contain catalytic systems that include transition-metal complexes of ligands which are heteroatom-containing dioxo ligands, such as derivatives of 3-hydroxy-4(1H)-pyridinone.

Additionally, the present disclosure details the use of metal bleach catalysts for the oxidation of organic compounds in synthetic applications. This includes, but is not limited to, the oxidation of alkanes, alkenes, alkynes, and aryl compounds from petroleum or natural sources into oxidized products as raw materials for the chemical industry and the oxidation of organic compounds for the synthesis of high-value specialty chemicals, such as drugs and functional materials.

Additionally, the present disclosure details the use of metal bleach catalysts for the oxidation of organic substrates in decontamination processes, including, but not limited to the bleaching of dyes and oxidation of other organic contaminants from waste water, the removal of malodor from solutions, sludge or hard surfaces and the oxidation of hydrophobic organic materials in the decontamination of soil.

Additionally, the present disclosure details the use of the metal bleach catalysts for the bleaching of pulp in the manufacturing of paper.

Additionally, the present disclosure details the use of metal bleach catalysts in hardening or drying of resins, paints, inks, surface coating, glues, sealants, in the polymerization of monomers and in cross-linking of polymers.

Additionally, the present disclosure details discloses the use of metal bleach catalysts for the disinfection of media contaminated by bacteria and viruses, for instance but not limited to aqueous solutions, hard surfaces, surgical instruments.

The present disclosure also details the use of metal bleach catalysts for the oxidation of oxidizable compounds (e.g., stains) on surfaces such as fabrics, dishes, countertops, dentures and the like; for the oxidation of oxidizable compounds in solution; for dye transfer inhibition in the laundering of fabrics; and for the decontamination of soils on fabrics.

According to one embodiment, the present disclosure provides for a laundry or cleaning composition comprising:

(a) a catalytically effective amount, preferably from about 0.00001% to about 10%, or from about 0.0001 to about 6%, or from about 0.0003 to about 3%; or from about 0.001 to about 1%; or from about 0.006 to about 0.3%; or from about 0.02 to about 0.1% of a transition-metal bleach catalyst, wherein said transition-metal bleach catalyst comprises a complex of a transition metal selected from the group consisting of Mn(II), Mn(III), Mn(IV), Mn(V), Cu(I), Cu(II), Cu(III), Fe(II), Fe(III), Fe(IV), Fe(V), Co(I), Co(II), Co(III), Ti(II), Ti(III), Ti(IV), V(II), V(III), V(IV), V(V), Mo(II), Mo(III), Mo(IV), Mo(V), Mo(VI), W(IV), W(V) and W(VI) coordinated with a dioxo ligand, preferably a heteroatom-containing dioxo ligands having 2 donor atoms; and (b) the balance, to 100%, of one or more adjunct materials.

DETAILED DESCRIPTION OF THE INVENTION

Highly useful metal bleach catalysts, compositions, and methods employing such metal bleach catalysts are detailed herein. The metal bleach catalysts detailed herein provide increased bleaching effectiveness even at low temperatures, reducing the need to apply excess heat to activate the desired chemistry, thus minimizing unwanted side reaction and reducing energy costs, a growing consideration both in commercial chemical processes as well as consumer applications. The metal bleach catalysts detailed herein act in conjunction with or without, preferably with, conventional peroxygen bleaching sources to provide the above mentioned increased bleaching effectiveness.

Although a variety of primary oxidants can be used, the ability to use hydrogen peroxide and persulfate as primary oxidants enables improved cost as well as enables green by-products. The use of manganese over more toxic metals also satisfies the ongoing need to provide environmentally benign metal bleach catalysts. In addition, the synthesis of the dioxo ligands of the present invention is cost effective; for example, derivatives of 3-hydroxy-4(1H)-pyridinones and some hydroxypyranones are derivatives of maltol, which is a natural compound providing a primary building block with sustainable origin, as well as potential for low cost.

DEFINITIONS

As used herein "consumer product" means baby care, beauty care, fabric & home care, family care, feminine care, health care, snack and/or beverage products or devices intended to be used or consumed in the form in which it is sold, and not intended for subsequent commercial manufacture or modification. Such products include but are not limited to diapers, bibs, wipes; products for and/or methods relating to treating hair (human, dog, and/or cat), including, bleaching, coloring, dyeing, conditioning, shampooing, styling; deodorants and antiperspirants; personal cleansing; cosmetics; skin care including application of creams, lotions, and other topically applied products for consumer use; and shaving products, products for and/or methods relating to treating fabrics, hard surfaces and any other surfaces in the area of fabric and home care, including: air care, car care, dishwashing, fabric conditioning (including softening), laundry detergency, laundry and rinse additive and/or care, hard surface cleaning and/or treatment, and other cleaning for consumer or institutional use; products and/or methods relating to bath tissue, facial tissue, paper handkerchiefs, and/or paper towels; tampons, feminine napkins; products and/or methods relating to oral care including toothpastes, tooth gels, tooth rinses, denture adhesives, tooth whitening; and over-the-counter health care including water purification.

As used herein, the term "cleaning and/or treatment composition" is a subset of consumer products. Such products include, but are not limited to, products for treating fabrics, hard surfaces and any other surfaces in the area of fabric and home care, including: air care including air fresheners and scent delivery systems, car care, dishwashing, fabric conditioning (including softening and/or freshening), laundry detergency, laundry and rinse additive and/or care, hard surface cleaning and/or treatment including floor and toilet bowl cleaners, granular or powder-form all-purpose or "heavy-duty" washing agents, especially cleaning detergents; liquid, gel or paste-form all-purpose washing agents, especially the so-called heavy-duty liquid (HDL) types; liquid fine-fabric detergents; hand dishwashing agents or light duty dishwashing agents, especially those of the high-foaming type; machine dishwashing agents, including the various tablet, granular, liquid and rinse-aid types for household and institutional use: car or carpet shampoos, bathroom cleaners including toilet bowl cleaners; as well as cleaning auxiliaries such as bleach additives and "stain-stick" or pre-treat types, substrate-laden products such as dryer added sheets.

As used herein, the term "fabric and/or hard surface cleaning and/or treatment composition" is a subset of cleaning and treatment compositions that includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various tablet, granular, liquid and rinse-aid types for household and institutional use; liquid cleaning and disinfecting agents, car or carpet shampoos, bathroom cleaners including toilet bowl cleaners; fabric conditioning products including softening and/or freshening that may be in liquid, solid and/or dryer sheet form; as well as cleaning auxiliaries such as bleach additives and "stain-stick" or pre-treat types, substrate-laden products such as dryer added sheets. All of such products which are applicable may be in standard, concentrated or even highly concentrated form even to the extent that such products may in certain aspect be non-aqueous.

As used herein, the term "hair and/or skin cleaning and/or treatment composition" is a subset of "consumer product" and includes products designed for hair bleaching and oxidation of hair dye precursors (e.g., as part of a hair-dye system).

As used herein, articles such as "a" and "an" when used in a claim, are understood to mean one or more of what is claimed or described.

As used herein, the terms "include", "includes" and "including" are meant to be non-limiting.

As used herein, the term "solid" includes granular, powder, bar and tablet product forms.

As used herein, the term "fluid" includes liquid, gel, paste and gas product forms.

As used herein, the term "situs" includes paper products, fabrics, garments, hard surfaces, hair and skin.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Metal Bleach Catalyst:

The metal bleach catalysts detailed herein, also known as complexes of metals and organic substances, are of the general formula: $[M_aL_bN_c]P_d$, in which "M" represents a metal, "L" represents a ligand, "N" represents an optional coordinating group, "P" represents an optional counterion, and "a," "b," "c" and "d" are positive integers when present.

Referring to the general formula detailed above, suitable metals represented by "M" may include transition metals such as manganese, iron, copper, cobalt, titanium, vanadium, molybdenum and tungsten (all in various oxidation states). In certain embodiments of the metal bleach catalysts described herein, "M" may be independently selected from Mn(II), Mn(III), Mn(IV), Mn(V), Cu(I), Cu(II), Cu(III), Fe(II), Fe(III), Fe(IV), Fe(V), Co(I), Co(II), Co(III), Ti(II), Ti(III), Ti(IV), V(II), V(III), V(IV), V(V), Mo(II), Mo(III), Mo(IV), Mo(V), Mo(VI), W(IV), W(V) and W(VI).

In some embodiments of the metal bleach catalysts described herein, "M" may be independently selected from Mn(II), Mn(III), Mn(IV), Mn(V), Fe(II), Fe(III) or Fe(IV). In still other embodiments of the metal bleach catalysts described herein, "M" may be independently selected from Mn(II), Mn(III), Mn(IV) or Mn(V).

In certain embodiments of the metal bleach catalysts described herein, "a" may represent an integer from 1 to 10, or in some embodiments, 1 to 4.

Suitable ligands represented by "L" may include a ligand of the general formula $L^1$ or $L^2$, as detailed below:

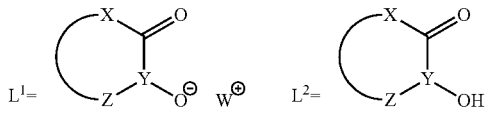

wherein "W" may be selected from any organic or inorganic cationic species, and wherein "W" represents any suitable charge balancing counterion; specific examples of "W" include, but are not limited to, H+, $Li^+$, $Na^+$, $K^+$, $NH_4^+$ and $(n\text{-}C_4H_9)_4N^+$. When "W" is H+, the ligand of the general formula $L^1$ equals the ligand of the general formula $L^2$. "Y" may be selected from carbon and nitrogen. In embodiments where "Y" is a carbon atom, the Y—Z bond is a double bond, and in embodiments wherein "Y" is a nitrogen atom, the Y—Z bond is a single bond. "X" and "Z" may be linked to form an aromatic structure provided that "X," "Y," "Z" are selected such that at least one heteroatom is present in the aromatic structure and therefore forms a heteroaromatic compound.

Optionally, the heteroaromatic compound can be substituted at any available position by one or more organic groups. The term "organic groups" includes, but is not limited to, alkyl, trifluoromethyl, cycloalkyl, cycloalkylalkyl, alkenyl, alkinyl, heteroalkyl, heterocycloalkyl, alkoxy, alkylsulfanyl, alkylsulfinyl, alkylsulfonyl, alkanoyl, alkanoyloxy, alkoxycarbonyl, alkylaminocarbonyl, alkylsulfanylcarbonyl, hydroxy, amino, aryl, arylalkyl, aryloxy, alkyloxy, arylsulfanyl, arylsulfinyl, arylsulfonyl, arylcarbonyl, arylcarbonyloxy, aryloxycarbonyl, arylaminocarbonyl, arylsulfanylcarbonyl, heteroaryl, heteroarylalkyl, heteroaryloxy, heteroarylamino, heteroarylsulfanyl, heteroarylsulfonyl, heteroarylsulfoxidyl, heteroarylcarbonyl, heteroarylcarbonyloxy, heteroaryloxycarbonyl, heteroarylaminocarbonyl, heteroarylsulfanylcarbonyl, alkoxysulfonyl, alkoxycarbinol, ammonium, hydroxycarbonyl, alkoxycarbonyl, aryloxycarbonyl, amido, amidocarbonyl, halogen, nitro, sulfato, sulfo, amidosulfo, phosphato, phosphono, amidophosphono, formyl, and thioformyl; and wherein all residues of a so resulting molecule, mutually independently in each case, can optionally also be mono- or polysubstituted; and wherein when two or more substituents are linked together so as to form one or more additional cycles, saturated or unsaturated, in the ligand structure.

In another embodiment, the heteroaromatic compound can be substituted at any available position by one or more organic groups, including, but not limited to alkyl groups, aryl groups, hydroxyl group, aryloxy group, alkyloxy group, amido groups, amino groups and carbonyl groups. In the case of two or more substituents, embodiments of the metal bleach catalysts detailed herein also include complexes where these substituents are linked together so as to form one or more additional cycles, saturated or unsaturated, in the ligand structure.

Non-limiting examples of ligands suitable for use in the metal bleach catalysts detailed herein (i.e., represented by "L" in the metal bleach catalyst general formula detailed above) may be independently selected from a group comprising:

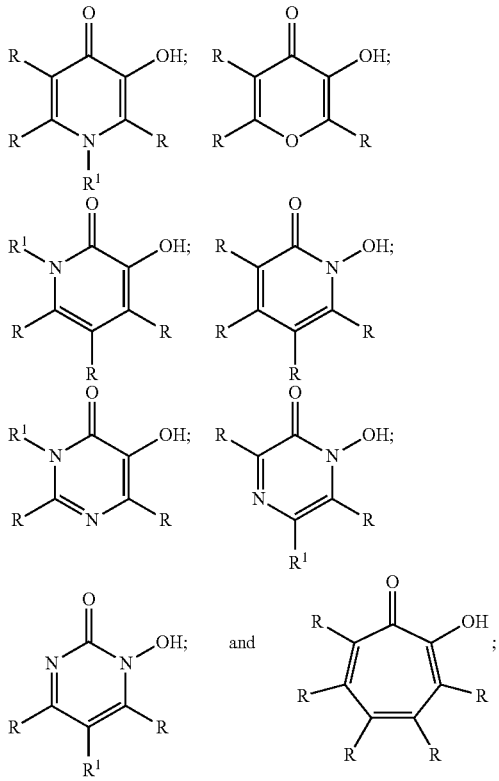

wherein R is hydrogen, alkyl, alkenyl, alkynyl, aryl group, optionally substituted; and R1 is alkyl, alkenyl, alkynyl, aryl, optionally substituted. In certain embodiments, R is H or methyl.

In certain embodiments of the metal bleach catalysts described herein, "b" may represent an integer from 1 to 30, or in some embodiments, 1 to 12.

Suitable coordinating groups represented by "N" may include a coordinating species, either organic or inorganic, monodentate or polydentate, negatively charged or neutral, able to bind one or more of the metal atoms in a mono or polydentate manner. Non-limiting examples of suitable coordinating groups may be independently selected from a group comprising $O_2^-$, $RBO_2^{2-}$, $RCO_2^-$, $RCONR^-$, $HO^-$, $RS^-$, $PO_4^{3-}$, $PO_3OR^{3-}$, $H_2O$, $CO_3^{2-}$, $HCO_3^-$, ROH, $NR_3$, $ROO^-$, $O_2^{2-}$, $O_2^-$, RCN, $Cl^-$, $Br^-$, $F^-$, $I^-$, $NCO^-$, $NCS^-$, $CN^-$, $N_3^-$, $RO^-$, $ClO_4^-$, $NO_3^-$, $RSO_3^-$ and nitrogen-based heteroaromatic compounds. In those non-limiting examples of the coordinating groups detailed above that include an "R" group, where the "R" represents an organic radical.

In certain embodiments of the metal bleach catalysts described herein, "c" may represent an integer from 1 to 10, or in some embodiments, 1 to 6.

Suitable non-coordinating counter ions are represented by "P" and may be independently selected from a group comprising $ClO_4^-$, $BR_4^-$, $PF_6^-$, $RCO_2^-$, $NO_3^-$, $RO^-$, $R_4N^+$, $ROO^-$, $O_2^{2-}$, $O_2^-$, $Cl^-$, $Br^-$, $F^-$, $I^-$, $SO_4^{2-}$, $RSO_3^-$, $S_2O_6^-$, NCO—, NCS—, $CO_3^{2-}$, $HCO_3^-$, $H_2O$, $BF_4^-$, $N_3^-$, $PO_4^{3-}$, $PO_3OR^{3-}$, $RBO_2^{2-}$. In those non-limiting examples of the non-coordinating counter ions detailed above that include an "R" group. "R" represents an organic radical.

In certain embodiments of the metal bleach catalysts described herein, "d" may represent an integer from 1 to 10, or in some embodiments, 1 to 6.

In some embodiments of the metal bleach catalysts where "a" is greater than 1, all of the "M" groups may be the same element and such element may be of the same or different oxidation states. In other embodiments of the metal bleach catalysts where "a" is greater than 1, the "M" groups may be different elements and/or different oxidation states. In some embodiments of the metal bleach catalysts where "b" is greater than 1, all the "L" groups may be the same moiety. In other embodiments of the metal bleach catalysts, the "L" groups may be individually selected in any combination. Moreover, the metal bleach catalysts detailed herein may include "L" groups that can either function as a monodentate ligand, a bidentate ligand or a multidentate ligand (if any substitution of the ligand itself can bind the metal atom(s)).

Transition-metal bleach catalysts of dioxo ligands which are suitable for use in the cleaning compositions and methods of bleaching described herein may include compounds that conform to the general description above. Specific non-limiting examples of appropriate metal bleach catalysts may include one or more metal bleach catalyst comprising a complex of:

A) a transition metal selected from the group consisting of Mn(II), Mn(III), Mn(IV), Mn(V), Fe(II), Fe(III) and Fe(IV); and B) one or more dioxo ligands selected from the group consisting of:

(i)

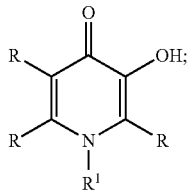

-continued (ii)

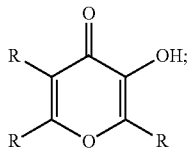

(iii)

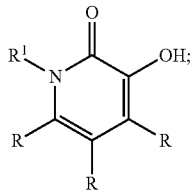

(iv)

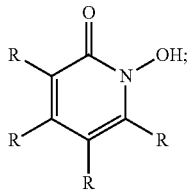

(v)

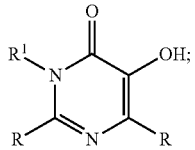

(vi)

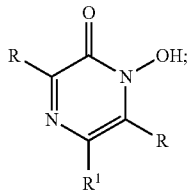

(vii)

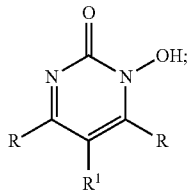

(viii)

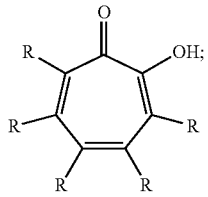

and (ix) combinations thereof, wherein R and R1 are independently selected from H and organic group.

Additional specific non-limiting examples of appropriate metal bleach catalysts may include one or more of the following:

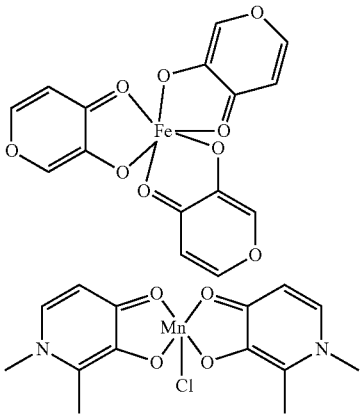

One interesting metal bleach catalyst for use in the cleaning compositions detailed herein is:

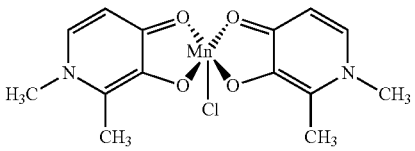

Another interesting metal bleach catalyst for use in the cleaning compositions detailed herein is:

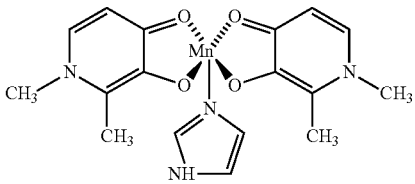

Another interesting metal bleach catalyst for use in the cleaning compositions detailed herein is:

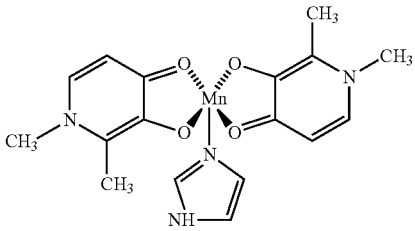

The metal bleach catalysts described herein may be present in the cleaning compositions described herein in an amount ranging from about 0.00001% to about 10%, or from about 0.0001 to about 6%, or from about 0.0003 to about 3%; or from about 0.001 to about 1%; or from about 0.006 to about 0.3%; or from about 0.02 to about 0.1%.

In another embodiment, a suitable bleach catalyst comprises at least one component selected from the group consisting of a ligand of the general formula L, ligand-metal complex of a ligand of the general formula (L), and combinations thereof:

L

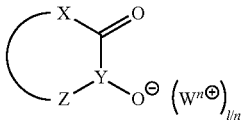

preferably wherein the molecular weight of L is less than 600; "W" represents any suitable charge balancing counterion; n is an integer from 1 to 3; "Y" is selected from carbon and nitrogen; wherein when "Y" is a nitrogen atom, the Y—Z bond is a single bond; "X" and "Z" are linked to form an aromatic structure; "X," "Y," "Z" are selected such that at least one heteroatom is present in the aromatic structure and forms a heteroaromatic compound; any hydrogen on the heteroaromatic compound may be substituted by an organic substituent.

In another embodiment, a suitable bleach catalyst is selected wherein said L is selected from the group consisting of:

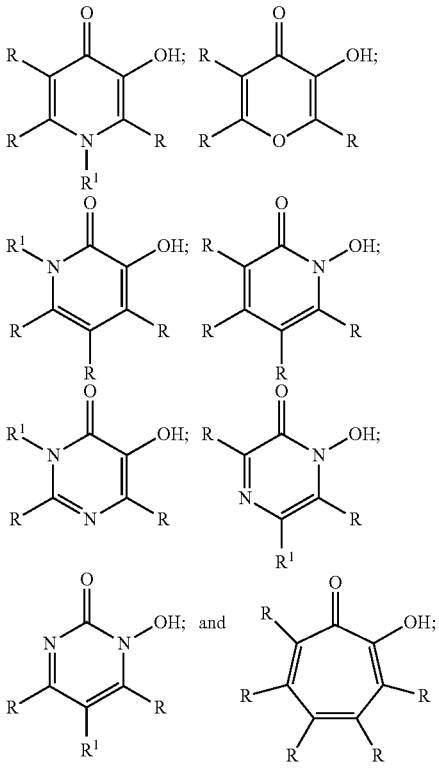

and combinations thereof, where R and R1 are independently selected from H and an organic group.

In one embodiment, the bleach catalyst of the present invention further comprises an imidazole ligand.

In another embodiment, a composition may comprise 0.001 to about 1% of the metal bleach catalyst as described herein, and at least one adjunct ingredient selected from the group consisting of: a surfactant, a builder, a chelating agent, a dye transfer inhibiting agent, a dispersant, one or more additional enzymes, an enzyme stabilizer, a catalytic material, a bleach activator, a hydrogen peroxide, a source of hydrogen peroxide, a preformed peracid, a polymeric dispersing agent, a clay soil removal/anti-redeposition agent, a brightener, a suds suppressor, a dye, a perfume, a perfume delivery system, a structure elasticizing agent, a fabric softener, a carrier, a hydrotrope, an encapsulate comprising a perfume, a hueing agent, an amphiphilic cleaning polymer, a processing aid, a solvent, a pigment and mixtures thereof.

In one embodiment, the adjunct ingredient includes both an oxygen bleaching agent and at least one other adjunct material selected from non-bleaching adjuncts suited for laundry detergents or cleaning products. Non-bleaching adjuncts as defined herein are adjuncts useful in detergents and cleaning products which neither bleach on their own, nor are recognized as adjuncts used in cleaning primarily as promoters of bleaching such as is the case with bleach activators, organic bleach catalysts or peracids. Preferred non-bleaching adjuncts include detersive surfactants, detergent builders, non-bleaching enzymes having a useful function in detergents, and the like. Preferred compositions herein can incorporate a source of hydrogen peroxide which is any common hydrogen-peroxide releasing salt, such as sodium perborate, sodium percarbonate, and mixtures thereof.

In another embodiment, a bleach catalyst comprises at least one component selected from the group consisting of a ligand of the general formula L, ligand-metal complex of a ligand of the general formula (L), and combinations wherein the adjunct ingredients do not include an oxygen bleaching agent. Without being bound by theory, the bleach catalyst can interact with peroxides, such as hydroperoxides (ROOH) present from autoxidation reactions, including within oily stains on textiles.

In another embodiment, a bleach catalyst comprises a ligand-metal complex of a ligand of the general formula (L) and a transition metal wherein the ligand-metal complex is pre-formed and added as a pre-formed metal bleach catalysts to the consumer product composition.

In another embodiment, a bleach catalyst comprises a ligand of the general formula L and a metal represented by "M", wherein the ligand and metal are not pre-complexed, but added separately to the composition or wash solution.

In another embodiment, a bleach catalyst comprises a ligand of the general formula L wherein the metal represented by "M" includes transition metals such as manganese, iron, and copper (all in various oxidation states), wherein the metal is not purposely added, but instead is present naturally. Such natural or fugitive metals can originate from a variety of sources, including but not limited to, wash water, textile stains (e.g., clays), fabric coatings, detergent raw materials contamination, and the like. Without being bound by theory, the ligand of the general formula L can complex with fugitive metals to provide the ligand-metal complex described in the present invention.

Also disclosed herein are methods of treating textile, wherein the method may comprise the steps of:

(i) treating a textile with an aqueous solution of a metal bleach catalyst, suitable for providing a bleaching benefit to fabric, the aqueous solution comprising from 1 ppb to 5 ppm of the metal bleach catalyst and from 0.1 g/L to 2 g/L of a surfactant; and, (ii) rinsing and drying the textile;

wherein the metal bleach catalyst is selected from the group consisting of a ligand of the general formula L, ligand-metal complex of a ligand of the general formula L, and combinations thereof:

L

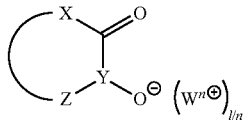

preferably wherein the molecular weight of L is less than 600; "W" represents any suitable charge balancing counterion; n is an integer from 1 to 3; "Y" is selected from carbon and nitrogen; wherein when "Y" is a nitrogen atom, the Y—Z bond is a single bond; "X" and "Z" are linked to form an aromatic structure; "X," "Y," "Z" are selected such that at least one heteroatom is present in the aromatic structure and forms a heteroaromatic compound; any hydrogen on the heteroaromatic compound may be substituted by an organic substituent.

Other methods that are encompassed by the present disclosure include but are not limited to the following:

A method comprising: (a) providing a textile fabric; and (b) contacting the textile fabric with a metal bleach catalyst of detailed herein.

A method comprising: (a) providing a hard surface; and (b) contacting the hard surface with a metal bleach catalyst of detailed herein.

A method comprising: (a) providing at least one substrate selected from the group consisting of wood pulp and raw cotton; and (b) contacting the at least one substrate with a metal bleach catalyst of detailed herein.

A method comprising: (a) providing a textile fabric; and (b) contacting the textile fabric with a metal bleach catalyst of detailed herein.

A method comprising: (a) providing a hard surface; and (b) contacting the hard surface with a metal bleach catalyst of detailed herein.

Adjunct Materials:

While not essential for the purposes of the present invention, the non-limiting list of adjuncts illustrated hereinafter are suitable for use in consumer products and may be desirably incorporated in certain embodiments of the invention, for example to assist or enhance cleaning performance, for treatment of the substrate to be cleaned, or to modify the aesthetics of the consumer product as is the case with perfumes, colorants, dyes or the like. The levels of any such adjuncts incorporated in any fabric and home care product are in addition to any materials previously recited for incorporation. The precise nature of these additional components, and levels of incorporation thereof, will depend on the physical form of the consumer product and the nature of the cleaning operation for which it is to be used. Suitable adjunct materials include, but are not limited to, surfactants, builders, chelating agents, dye transfer inhibiting agents, dispersants, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, hueing dyes, perfumes, perfume delivery systems, structure elasticizing agents, fabric softeners, carriers, hydrotropes, processing aids, solvents and/or pigments. In addition to the disclosure below, suitable examples of such other adjuncts and levels of use are found in U.S. Pat. Nos. 5,576,282, 6,306,812 B1 and 6,326,348 B1 that are incorporated herein by reference.

As stated, the adjunct ingredients are not essential to Applicants' consumer products. Thus, certain embodiments of Applicants' consumer products do not contain one or more of the following adjuncts materials: surfactants, builders, chelating agents, dye transfer inhibiting agents, dispersants, additional enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, perfumes, perfume delivery systems, structure elasticizing agents, fabric softeners, carriers, hydrotropes, processing aids, solvents and/or pigments. However, when one or more adjuncts are present, such one or more adjuncts may be present as detailed below:

Fabric Hueing Agents

The composition may comprise a fabric hueing agent. Suitable fabric hueing agents include dyes, dye-clay conjugates, and pigments. Suitable dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof.

Encapsulates

The composition may comprise an encapsulate. In one aspect, an encapsulate comprising a core, a shell having an inner and outer surface, said shell encapsulating said core.

In one aspect of said encapsulate, said core may comprise a material selected from the group consisting of perfumes; brighteners; dyes; insect repellants; silicones; waxes; flavors; vitamins; fabric softening agents; skin care agents in one aspect, paraffins; enzymes; anti-bacterial agents; bleaches; sensates; and mixtures thereof; and said shell may comprise a material selected from the group consisting of polyethylenes; polyamides; polystyrenes; polyisoprenes; polycarbonates; polyesters; polyacrylates; aminoplasts, in one aspect said aminoplast may comprise a polyureas, polyurethane, and/or polyureaurethane, in one aspect said polyurea may comprise polyoxymethyleneurea and/or melamine formaldehyde; polyolefins; polysaccharides, in one aspect said polysaccharide may comprise alginate and/or chitosan; gelatin; shellac; epoxy resins; vinyl polymers; water insoluble inorganics; silicone; and mixtures thereof.

In one aspect of said encapsulate, said core may comprise perfume.

In one aspect of said encapsulate, said shell may comprise melamine formaldehyde and/or cross linked melamine formaldehyde.

In one aspect, said encapsulates' wall material may comprise a suitable resin including the reaction product of an aldehyde and an amine, suitable aldehydes include, formaldehyde. Suitable amines include melamine, urea, benzoguanamine, glycoluril, and mixtures thereof. Suitable melamines include, methylol melamine, methylated methylol melamine, imino melamine and mixtures thereof. Suitable ureas include, dimethylol urea, methylated dimethylol urea, urea-resorcinol, and mixtures thereof.

In one aspect, suitable formaldehyde scavengers may be employed with the encapsulates, for example, in a capsule slurry and/or added to a consumer product before, during or after the encapsulates are added to such consumer product.

Suitable capsules that can be made by following the teaching of USPA 2008/0305982 A1; and/or USPA 2009/0247449 A1. Alternatively, suitable capsules can be purchased from Appleton Papers Inc. of Appleton, Wis. USA.

Polymers

The consumer product may comprise one or more polymers. Examples are carboxymethylcellulose, poly(vinyl-pyrrolidone), poly(ethylene glycol), poly(vinyl alcohol), poly (vinylpyridine-N-oxide), poly(vinylimidazole), polycarboxylates such as polyacrylates, maleic/acrylic acid copolymers and lauryl methacrylate/acrylic acid co-polymers.

The consumer product may comprise one or more amphiphilic cleaning polymers such as the compound having the following general structure: bis$((C_2H_5O)(C_2H_4O)n)(CH_3)$—$N^+$—$C_xH_{2x}$—$N^+$—$(CH_3)$-bis$((C_2H_5O)(C_2H_4O)n)$, wherein n=from 20 to 30, and x=from 3 to 8, or sulphated or sulphonated variants thereof.

The consumer product may comprise amphiphilic alkoxylated grease cleaning polymers which have balanced hydrophilic and hydrophobic properties such that they remove grease particles from fabrics and surfaces. Specific embodiments of the amphiphilic alkoxylated grease cleaning polymers of the present invention comprise a core structure and a plurality of alkoxylate groups attached to that core structure. These may comprise alkoxylated polyalkylenimines, preferably having an inner polyethylene oxide block and an outer polypropylene oxide block.

Carboxylate polymer—The consumer products of the present invention may also include one or more carboxylate polymers such as a maleate/acrylate random copolymer or polyacrylate homopolymer. In one aspect, the carboxylate polymer is a polyacrylate homopolymer having a molecular weight of from 4,000 Da to 9,000 Da, or from 6,000 Da to 9,000 Da.

Soil release polymer—The consumer products of the present invention may also include one or more soil release polymers having a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are polyester soil release polymers such as Repel-o-tex® polymers, including Repel-o-tex® SF, SF-2 and SRP6 supplied by Rhodia. Other suitable soil release polymers include Texcare® polymers, including Texcare® SRA100, SRA300, SRN100, SRN170, SRN240, SRN300 and SRN325 supplied by Clariant. Other suitable soil release polymers are Marloquest® polymers, such as Marloquest® SL supplied by Sasol.

Cellulosic polymer—The consumer products of the present invention may also include one or more cellulosic polymers including those selected from alkyl cellulose, alkyl alkoxyalkyl cellulose, carboxyalkyl cellulose, alkyl carboxyalkyl cellulose. In one aspect, the cellulosic polymers are selected from the group comprising carboxymethyl cellulose, methyl cellulose, methyl hydroxyethyl cellulose, methyl carboxymethyl cellulose, and mixtures thereof. In one aspect, the carboxymethyl cellulose has a degree of carboxymethyl substitution from 0.5 to 0.9 and a molecular weight from 100,000 Da to 300,000 Da.

Enzymes

The compositions can comprise one or more detergent enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

Enzyme Stabilizers

Enzymes for use in compositions, for example, detergents can be stabilized by various techniques. The enzymes employed herein can be stabilized by the presence of water-soluble sources of calcium and/or magnesium ions in the finished compositions that provide such ions to the enzymes.

Bleaching Agents

The consumer products of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the consumer products of the present invention may comprise from about 0.1% to about 50% or even from about 0.1% to about 25% bleaching agent by weight of the subject consumer product. Examples of suitable bleaching agents include:

(1) photobleaches for example sulfonated zinc phthalocyanine sulfonated aluminium phthalocyanines, xanthene dyes and mixtures thereof;

(2) preformed peracids: Suitable preformed peracids include, but are not limited to, compounds selected from the group consisting of percarboxylic acids and salts, percarbonic acids and salts, perimidic acids and salts, peroxymonosulfuric acids and salts, for example, Oxone®, and mixtures thereof. Suitable percarboxylic acids include hydrophobic and hydrophilic peracids having the formula R—(C═O)O—O-M wherein R is an alkyl group, optionally branched, having, when the peracid is hydrophobic, from 6 to 14 carbon atoms, or from 8 to 12 carbon atoms and, when the peracid is hydrophilic, less than 6 carbon atoms or even less than 4 carbon atoms; and M is a counterion, for example, sodium, potassium or hydrogen;

(3) sources of hydrogen peroxide, for example, inorganic perhydrate salts, including alkali metal salts such as sodium salts of perborate (usually mono- or tetra-hydrate), percarbonate, persulphate, perphosphate, persilicate salts and mixtures thereof. In one aspect of the invention the inorganic perhydrate salts are selected from the group consisting of sodium salts of perborate, percarbonate and mixtures thereof. When employed, inorganic perhydrate salts are typically present in amounts of from 0.05 to 40 wt %, or 1 to 30 wt % of the overall fabric and home care product and are typically incorporated into such fabric and home care products as a crystalline solid that may be coated. Suitable coatings include, inorganic salts such as alkali metal silicate, carbonate or borate salts or mixtures thereof, or organic materials such as water-soluble or dispersible polymers, waxes, oils or fatty soaps; and (4) bleach activators having R—(C═O)-L wherein R is an alkyl group, optionally branched, having, when the bleach activator is hydrophobic, from 6 to 14 carbon atoms, or from 8 to 12 carbon atoms and, when the bleach activator is hydrophilic, less than 6 carbon atoms or even less than 4 carbon atoms; and L is leaving group. Examples of suitable leaving groups are benzoic acid and derivatives thereof—especially benzene sulphonate. Suitable bleach activators include dodecanoyl oxybenzene sulphonate, decanoyl oxybenzene sulphonate, decanoyl oxybenzoic acid or salts thereof, 3,5,5-trimethyl hexanoyloxybenzene sulphonate, tetraacetyl ethylene diamine (TAED) and nonanoyloxybenzene sulphonate (NOBS). Suitable bleach activators are also disclosed in WO 98/17767. While any suitable bleach activator may be employed, in one aspect of the invention the subject consumer product may comprise NOBS, TAED or mixtures thereof.

When present, the peracid and/or bleach activator is generally present in the consumer product in an amount of from about 0.1 to about 60 wt %, from about 0.5 to about 40 wt % or even from about 0.6 to about 10 wt % based on the fabric and home care product. One or more hydrophobic peracids or precursors thereof may be used in combination with one or more hydrophilic peracid or precursor thereof.

The amounts of hydrogen peroxide source and peracid or bleach activator may be selected such that the molar ratio of available oxygen (from the peroxide source) to peracid is from 1:1 to 35:1, or even 2:1 to 10:1.

Surfactants

The consumer products according to the present invention may comprise a surfactant or surfactant system wherein the surfactant can be selected from nonionic surfactants, anionic surfactants, cationic surfactants, ampholytic surfactants, zwitterionic surfactants, semi-polar nonionic surfactants and mixtures thereof. When present, surfactant is typically present at a level of from about 0.1% to about 60%, from about 1% to about 50% or even from about 5% to about 40% by weight of the subject consumer product.

Suitable anionic detersive surfactants include sulphate and sulphonate detersive surfactants.

Suitable sulphonate detersive surfactants include alkyl benzene sulphonate, in one aspect, $C_{10-13}$ alkyl benzene sulphonate. Suitable alkyl benzene sulphonate (LAS) may be obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable.

Suitable sulphate detersive surfactants include alkyl sulphate, in one aspect, $C_{8-18}$ alkyl sulphate, or predominantly $C_{12}$ alkyl sulphate.

Another suitable sulphate detersive surfactant is alkyl alkoxylated sulphate, in one aspect, alkyl ethoxylated sulphate, in one aspect, a $C_{8-18}$ alkyl alkoxylated sulphate, in another aspect, a $C_{8-18}$ alkyl ethoxylated sulphate, typically the alkyl alkoxylated sulphate has an average degree of alkoxylation of from 0.5 to 20, or from 0.5 to 10, typically the alkyl alkoxylated sulphate is a $C_{8-18}$ alkyl ethoxylated sulphate having an average degree of ethoxylation of from 0.5 to 10, from 0.5 to 7, from 0.5 to 5 or even from 0.5 to 3.

The alkyl sulphate, alkyl alkoxylated sulphate and alkyl benzene sulphonates may be linear or branched, substituted or un-substituted.

The detersive surfactant may be a mid-chain branched detersive surfactant, in one aspect, a mid-chain branched anionic detersive surfactant, in one aspect, a mid-chain branched alkyl sulphate and/or a mid-chain branched alkyl benzene sulphonate, for example a mid-chain branched alkyl sulphate. In one aspect, the mid-chain branches are $C_{1-4}$ alkyl groups, typically methyl and/or ethyl groups.

Suitable non-ionic detersive surfactants are selected from the group consisting of: $C_8$-$C_{18}$ alkyl ethoxylates, such as, NEODOL® non-ionic surfactants from Shell; $C_6$-$C_{12}$ alkyl phenol alkoxylates wherein the alkoxylate units may be ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, typically having an average degree of alkoxylation of from 1 to 30; alkylpolysaccharides, in one aspect, alkylpolyglycosides; polyhydroxy fatty acid amides; ether capped poly(oxyalkylated) alcohol surfactants; and mixtures thereof.

Suitable non-ionic detersive surfactants include alkyl polyglucoside and/or an alkyl alkoxylated alcohol.

In one aspect, non-ionic detersive surfactants include alkyl alkoxylated alcohols, in one aspect $C_{8-18}$ alkyl alkoxylated alcohol, for example a $C_{8-18}$ alkyl ethoxylated alcohol, the alkyl alkoxylated alcohol may have an average degree of alkoxylation of from 1 to 50, from 1 to 30, from 1 to 20, or from 1 to 10. In one aspect, the alkyl alkoxylated alcohol may be a $C_{8-18}$ alkyl ethoxylated alcohol having an average degree of ethoxylation of from 1 to 10, from 1 to 7, more from 1 to 5 or from 3 to 7. The alkyl alkoxylated alcohol can be linear or branched, and substituted or un-substituted.

Suitable cationic detersive surfactants include alkyl pyridinium compounds, alkyl quaternary ammonium compounds, alkyl quaternary phosphonium compounds, alkyl ternary sulphonium compounds, and mixtures thereof.

Suitable cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, suitable anions include: halides, for example chloride; sulphate; and sulphonate. Suitable cationic detersive surfactants are mono-$C_{6-18}$ alkyl mono-hydroxyethyl di-methyl quaternary ammonium chlorides. Highly suitable cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Builders

The consumer products of the present invention may comprise one or more detergent builders or builder systems. When a builder is used, the subject consumer product will typically comprise at least about 1%, from about 2% to about 60% or even from about 5% to about 10% builder by weight of the subject consumer product. The composition may even be substantially free of builder; substantially free means "no deliberately added" zeolite and/or phosphate. Typical zeolite builders include zeolite A, zeolite P and zeolite MAP. A typical phosphate builder is sodium tri-polyphosphate.

Chelating Agents

The consumer products herein may contain a chelating agent. Suitable chelating agents include copper, iron and/or manganese chelating agents and mixtures thereof. When a chelating agent is used, the subject consumer product may comprise from about 0.005% to about 15% or even from about 3.0% to about 10% chelating agent by weight of the subject consumer product. Suitable chelants include DTPA (Diethylene triamine pentaacetic acid), HEDP (Hydroxyethane diphosphonic acid), DTPMP (Diethylene triamine penta(methylene phosphonic acid)), 1,2-Dihydroxybenzene-3,5-disulfonic acid disodium salt hydrate, ethylenediamine, diethylene triamine, ethylenediaminedisuccinic acid (EDDS), N-hydroxyethylethylenediaminetri-acetic acid (HEDTA), triethylenetetraaminehexaacetic acid (TTHA), N-hydroxyethyliminodiacetic acid (HEIDA), dihydroxyethylglycine (DHEG), ethylenediaminetetrapropionic acid (EDTP) and derivatives thereof.

Dye Transfer Inhibiting Agents

The consumer products of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in a subject consumer product, the dye transfer inhibiting agents may be present at levels from about 0.0001% to about 10%, from about 0.01% to about 5% or even from about 0.1% to about 3% by weight of the consumer product.

Brighteners

The consumer products of the present invention can also contain additional components that may tint articles being cleaned, such as fluorescent brighteners.

The composition may comprise C.I. fluorescent brightener 260 in alpha-crystalline.

In one aspect, the brightener is a cold water soluble brightener, such as the C.I. fluorescent brightener 260 in alpha-crystalline form.

In one aspect the brightener is predominantly in alpha-crystalline form, which means that typically at least 50 wt %, at least 75 wt %, at least 90 wt %, at least 99 wt %, or even substantially all, of the C.I. fluorescent brightener 260 is in alpha-crystalline form.

The brightener is typically in micronized particulate form, having a weight average primary particle size of from 3 to 30 micrometers, from 3 micrometers to 20 micrometers, or from 3 to 10 micrometers.

The composition may comprises C.I. fluorescent brightener 260 in beta-crystalline form, and the weight ratio of: (i) C.I. fluorescent brightener 260 in alpha-crystalline form, to (ii) C.I. fluorescent brightener 260 in beta-crystalline form may be at least 0.1, or at least 0.6.

BE680847 relates to a process for making C.I fluorescent brightener 260 in alpha-crystalline form.

Suitable fluorescent brightener levels include lower levels of from about 0.01, from about 0.05, from about 0.1 or even from about 0.2 wt % to upper levels of 0.5 or even 0.75 wt %.

Bleach Catalysts

The consumer products of the present invention may also include one or more bleach catalysts capable of accepting an oxygen atom from a peroxyacid and/or salt thereof, and transferring the oxygen atom to an oxidizeable substrate. Suitable bleach catalysts include, but are not limited to: iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones and mixtures thereof, as described in USPA 2007/0173430 A1.

In another aspect, the laundry detergent composition comprises a bleach ingredient, the bleach ingredient have a log $P_{o/w}$ no greater than 0, no greater than −0.5, no greater than −1.0, no greater than −1.5, no greater than −2.0, no greater than −2.5, no greater than −3.0, or even no greater than −3.5. The method for determining log $P_{o/w}$ is described in more detail below.

Typically, the bleach ingredient is capable of generating a bleaching species having a $X_{SO}$ of from 0.01 to about 0.30, from 0.05 to about 0.25, or even from about 0.10 to 0.20. The method for determining $X_{SO}$ is described in more detail below. For example, bleaching ingredients having an isoquinolinium structure are capable of generating a bleaching species that has an oxaziridinium structure. In this example, the $X_{SO}$ is that of the oxaziridinium bleaching species.

Without wishing to be bound by theory, the inventors believe that controlling the electophilicity and hydrophobicity in this above described manner enables the bleach ingredient to be delivered substantially only to areas of the fabric that are more hydrophobic, and that contain electron rich soils, including visible chromophores, that are susceptible to bleaching by highly electrophilic oxidants.

In one aspect, the bleach catalyst has a structure corresponding to general formula below:

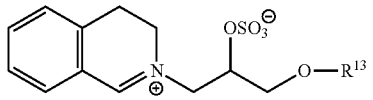

wherein $R^{13}$ is selected from the group consisting of 2-ethylhexyl, 2-propylheptyl, 2-butyloctyl, 2-pentylnonyl, 2-hexyldecyl, n-dodecyl, n-tetradecyl, n-hexadecyl, n-octadecyl, iso-nonyl, iso-decyl, iso-tridecyl and iso-pentadecyl;

Method of Determining log $P_{o/w}$

Log $P_{o/w}$ is determined according to the method found in Brooke, D. N., Dobbs, A. J., Williams, N, *Ecotoxicology and Environmental Safety* (1986) 11(3): 251-260.

Method of Determining Xso

The parameter Xso is determined according to the method described in Adam, W., Haas, W., Lohray, B. B. *Journal of the American Chemical Society* (1991) 113(16) 6202-6208.

Silicate Salts

The consumer products of the present invention can also contain silicate salts, such as sodium or potassium silicate. The composition may comprise from 0 wt % to less than 10 wt % silicate salt, to 9 wt %, or to 8 wt %, or to 7 wt %, or to 6 wt %, or to 5 wt %, or to 4 wt %, or to 3 wt %, or even to 2 wt %, and preferably from above 0 wt %, or from 0.5 wt %, or even from 1 wt % silicate salt. A suitable silicate salt is sodium silicate.

Dispersants

The consumer products of the present invention can also contain dispersants. Suitable water-soluble organic materials include the homo- or co-polymeric acids or their salts, in which the polycarboxylic acid comprises at least two carboxyl radicals separated from each other by not more than two carbon atoms.

Enzyme Stabilizers

Enzymes for use in consumer products can be stabilized by various techniques. The enzymes employed herein can be stabilized by the presence of water-soluble sources of calcium and/or magnesium ions in the finished fabric and home care products that provide such ions to the enzymes. In case of aqueous consumer products comprising protease, a reversible protease inhibitor, such as a boron compound, or compounds such as calcium formate, sodium formate and 1,2-propane diol can be added to further improve stability.

Catalytic Metal Complexes

Applicants' compositions may include additional catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. No. 5,597,936; U.S. Pat. No. 5,595,967. Such cobalt catalysts are readily prepared by known procedures, such as taught for example in U.S. Pat. No. 5,597,936, and U.S. U.S. Pat. No. 5,595,967.

Compositions herein may also suitably include a transition metal complex of ligands such as bispidones (WO 05/042532 A1) and/or macropolycyclic rigid ligands—abbreviated as "MRLs". As a practical matter, and not by way of limitation, the compositions and processes herein can be adjusted to provide on the order of at least one part per hundred million of the active MRL species in the aqueous washing medium, and will typically provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include, for example, manganese, iron and chromium. Suitable MRLs include 5,12-diethyl-1,5,8,12-tetraazabicyclo[6.6.2]hexadecane.

Suitable transition metal MRLs are readily prepared by known procedures, such as taught for example in WO 00/32601, and U.S. Pat. No. 6,225,464.

Solvents

Suitable solvents include water and other solvents such as lipophilic fluids. Examples of suitable lipophilic fluids include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

Processes of Making Consumer Products:

The consumer products of the present invention can be formulated into any suitable form and prepared by any process chosen by the formulator, non-limiting examples of which are described in Applicants' examples and in U.S. Pat. No. 4,990,280; U.S. 20030087791A1; U.S. 20030087790A1; U.S. 20050003983A1; U.S. 20040048764A1; U.S. Pat. No. 4,762,636; U.S. Pat. No. 6,291,412; U.S. 20050227891A1; EP 1070115A2; U.S. Pat. No. 5,879,584; U.S. Pat. No. 5,691,297; U.S. Pat. No. 5,574,005; U.S. Pat. No. 5,569,645; U.S. Pat. No. 5,565,422; U.S. Pat. No. 5,516,448; U.S. Pat. No. 5,489,392; U.S. Pat. No. 5,486,303 all of which are incorporated herein by reference.

Method of Use:

The present invention includes a method for cleaning and/or treating a situs inter alia a surface or fabric. In one aspect, such method comprises the steps of optionally washing and/or rinsing said surface or fabric, contacting said surface or fabric with any consumer product disclosed in this specification then optionally washing and/or rinsing said surface or fabric is disclosed.

The present invention includes a method for cleaning and/or treating a situs inter alia hair or skin. In one aspect, such method comprises the steps of optionally washing and/or rinsing said hair or skin, contacting said hair or skin with any consumer product disclosed in this specification then optionally washing and/or rinsing said hair or skin is disclosed.

As used herein, washing includes but is not limited to, scrubbing, and mechanical agitation. Drying of such surfaces or fabrics may be accomplished by any one of the common means employed either in domestic or industrial settings. Such means include but are not limited to forced air or still air drying at ambient or elevated temperatures at pressures between 5 and 0.01 atmospheres in the presence or absence of electromagnetic radiation, including sunlight, infrared, ultraviolet and microwave irradiation. In one aspect, said drying may be accomplished at temperatures above ambient by employing an iron wherein, for example, said fabric may be in direct contact with said iron for relatively short or even extended periods of time and wherein pressure may be exerted beyond that otherwise normally present due to gravitational force. In another aspect, said drying may be accomplished at temperatures above ambient by employing a dryer. Apparatus for drying fabric is well known and it is frequently referred to as a clothes dryer. In addition to clothes such appliances are used to dry many other items including towels, sheets, pillowcases, diapers and so forth and such equipment has been accepted as a standard convenience in many nations of the world substantially replacing the use of clothes lines for drying of fabric. Most dryers in use today use heated air which is passed over and or through the fabric as it is tumbled within the dryer. The air may be heated, for example, either electronically, via gas flame, or even with microwave radiation. Such air may be heated from about 15° C. to about 400° C., from about 25° C. to about 200° C., from about 35° C. to about 100° C., or even from about 40° C. to about 85° C. and used in the dryer to dry a surface and/or a fabric. As will be appreciated by one skilled in the art, the cleaning compositions of the present invention are ideally suited for use in laundry applications. Accordingly, the present invention includes a method for laundering a fabric. The method comprises the steps of contacting a fabric to be laundered with a said cleaning laundry solution comprising at least one embodiment of Applicants' cleaning composition, cleaning additive or mixture thereof. The fabric may comprise most any fabric capable of being laundered in normal consumer or institutional use conditions. The solution preferably has a pH of from about 6 to about 10.5. The compositions may be employed at concentrations of from about 500 ppm to about 15,000 ppm in solution. The water temperatures typically range from about 5° C. to about 90° C. The water to fabric ratio is typically from about 1:1 to about 30:1.

EXAMPLES

Example 1

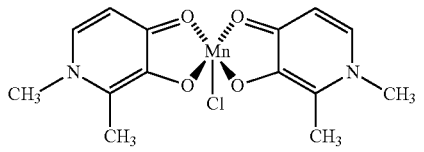

Synthesis of the HOPO complex (According to Wen-Yuan Hsieh et al., Inorg. Chem., 2005, 44, 2031): In 40 mL of acetonitrile is added 0.28 g of 1,2-dimethyl-3-hydroxy-4 (1H)-pyridinone (DMHP), 0.126 g of MnCl2 and 0.28 mL of triethylamine. The mixture turns dark green quickly and it is refluxed for 6 hrs. After cooling to room temperature, the mixture is reduced to about 5 mL on the rotary evaporator and poured into 100 mL of ice-cold diethylether. The greenish-brown solid that forms is filtered, rinsed with cold diethylether and dried in air. The yield of the (DMHP)2MnCl complex 1 is 0.315 g (84%).

IR (KBr, cm-1): 1456, 1501, 1547, 1605, 3434.

MS (ESI, positive mode): 331.13.

Elemental analysis: (DMHP)2MnCl. 0.25H2O: C, 45.27 (calculated 45.34); H, 4.42 (calc. 4.45); N, 7.57 (7.56).

Typical epoxidation reaction: In 10 mL of solvent at 0° C. (ice-bath) are added 0.04 mmol (DMHP)2MnCl, 0.2 mmol imidazole, 4 mmol substrate and 6 mmol oxidant (except H2O2: 18 mmol are used). After 30 min at 0° C., the mixture is stored at 4° C. for 23.5 hours. The mixture is then diluted with 10 mL of water and extracted once with 10 mL of diethyl ether. The organic phase is used for GC/MS quantification using bromobenzene as internal standard and the yield given as the percentage of substrate converted into the epoxide.

TABLE 1

Epoxidation of cyclooctene by (DMHP)2MnCl (1) as function of oxidant.

| Oxidant | Conversion (%) |
|---|---|
| $Bu_4N^+$, $HSO_5^-$ | 77 |
| $H_2O_2$ | 78 |
| PhIO | 36 |
| Urea•$H_2O_2$ | 20 |
| tBuOOH | 11 |
| $NaIO_4$ | 4 |
| $K^+$, $HSO_5^-$ | 0 |

TABLE 2

Epoxidation of oxidizable substrate by (DMHP)2MnCl (1) as function of alkene structure.

| Oxidant | Conversion (%) |
|---|---|
| Cyclooctene | 78% |
| Cyclohexene | 4% |
| cis-stilbene | 80% (in the ratio 43% cis, 57% trans) |
| styrene | 5% |
| 1-hexene | 2% |

TABLE 3

| Epoxidation of cyclooctene by (DMHP)2MnCl (1) as function of solvent. | |
|---|---|
| Solvent | Conversion |
| Acetonitrile | 78% |
| Acetone | 31% |
| Ethanol | 29% |
| Methanol | 13% |
| Water | 0% |
| Ethyl acetate | 0% |

TABLE 4

| Epoxidation of cyclooctene after 24 hours by 1 as function of temperature. | |
|---|---|
| Solvent | Conversion |
| 25° C. | 12% |
| 0° C. | 78% |
| −20° C. | 85% |

In the following Examples all levels are quoted as % by weight of the composition. The following examples are illustrative of the present invention, but are not meant to limit or otherwise define its scope. All parts, percentages and ratios used herein are expressed as percent weight unless otherwise specified.

Example 2

The following laundry detergent compositions, A-G are prepared as follows:

| Ingredient | A | B | C | D | E | F | G |
|---|---|---|---|---|---|---|---|
| Transition-Metal Bleach Catalyst[1] | 0.05 | 4.0 | 0.2 | 0.4 | 0.3 | 0.3 | 0.18 |

-continued

| Ingredient | A | B | C | D | E | F | G |
|---|---|---|---|---|---|---|---|
| Detergent[2] | 1000 | 2000 | 800 | 600 | 280 | 500 | 300 |
| Primary Oxidant[3] | 200 | 200 | 75 | 20 | 0 | 0.3 | 2.0 |
| TAED[4] | 40 | 20 | 0 | 0 | 0 | 0 | 0 |
| C8-14 Bleach Activator[5] | 0 | 20 | 15 | 0 | 0 | 0 | 0 |
| Chelant[6] | 2 | 8 | 3 | 5 | 2 | 0 | 0 |

wherein the quantities are parts by weight, e.g., kg or ppm.

[1]is the catalyst of any of the foregoing syntheses, e.g., of Synthesis Example 1;

[2]is a commercial detergent granule, e.g., TIDE ® or ARIEL ® having no bleach or transition-metal catalyst; or another conventional detergent powder, for example one built with sodium carbonate and/or zeolite A or P; or a standard liquid or powder commercial detergent such as available from American Association of Textile Chemists and Colorists (AATCC).

[3]is sodium perborate monohydrate or sodium perborate tetrahydrate or sodium percarbonate;

[4]is tetraacetylethylenediamine or any equivalent polyacetylethylenediamine, such as an unsymmetrical derivative;

[5]is any hydrophobic bleach activator having a carbon chain length in the indicated range, e.g., NOBS (C9) or an activator producing NAPAA on perhydrolysis (C9);

[6]is a commercial chelant, e.g., DTPA, or one from the DEQUEST ® series, or is S,S-ethylenediaminedisuccinate sodium salts.

The compositions are used for washing soiled fabrics in domestic U.S., European and Japanese automatic washing machines at water hardness in the range 0-20 gpg (grains per U.S. gallon) and temperatures in the range cold (5° C.) to about 90° C., more typically at ambient temperature to about 40° C. The tabulated amounts can be read in any convenient weight unit, for example kilograms for formulating purposes or, for a single wash, parts per million in the wash liquor. The wash pH is in the general range from about 6 to about 10, depending on product use per wash and soiling levels. Excellent results are obtained on various soiled articles (nine replicates per stain), such as T-shirts stained with grass, tea, wine, grape juice, barbecue sauce, beta-carotene or carrots. Evaluations are made by five trained panelists, by a group of about 60 consumers, or by use of an instrument such as a spectrometer.

Example 3

Granular Laundry Detergent Compositions

| wt % | A | B | C | D | E | F |
|---|---|---|---|---|---|---|
| Linear alkylbenzenesulfonate | 8 | 7.1 | 7 | 6.5 | 7.5 | 7.5 |
| AE3S | 0 | 4.8 | 0 | 5.2 | 4 | 4 |
| C12-14 Alkylsulfate | 1 | 0 | 1 | 0 | 0 | 0 |
| AE7 | 2.2 | 0 | 3.2 | 0 | 0 | 0 |
| $C_{10-12}$ Dimethyl hydroxyethylammonium chloride | 0.75 | 0.94 | 0.98 | 0.98 | 0 | 0 |
| Crystalline layered silicate (δ-$Na_2Si_2O_5$) | 4.1 | 0 | 4.8 | 0 | 0 | 0 |
| Zeolite A | 5 | 0 | 5 | 0 | 2 | 2 |
| Citric Acid | 3 | 5 | 3 | 4 | 2.5 | 3 |
| Sodium Carbonate | 15 | 20 | 14 | 20 | 23 | 23 |
| Silicate 2R ($SiO_2$:$Na_2O$ at ratio 2:1) | 0.08 | 0 | 0.11 | 0 | 0 | 0 |
| Soil release agent | 0.75 | 0.72 | 0.71 | 0.72 | 0 | 0 |
| Acrylic Acid/Maleic Acid Copolymer | 1.1 | 3.7 | 1.0 | 3.7 | 2.6 | 3.8 |
| Carboxymethylcellulose | 0.15 | 1.4 | 0.2 | 1.4 | 1 | 0.5 |
| Protease—Purafect ® (84 mg active/g) | 0.2 | 0.2 | 0.3 | 0.15 | 0.12 | 0.13 |
| Amylase—Stainzyme Plus ® (20 mg active/g) | 0.2 | 0.15 | 0.2 | 0.3 | 0.15 | 0.15 |
| Lipase—Lipex ® (18.00 mg active/g) | 0.05 | 0.15 | 0.1 | 0 | 0 | 0 |
| Amylase—Natalase ® (8.65 mg active/g) | 0.1 | 0.2 | 0 | 0 | 0.15 | 0.15 |
| Cellulase—Celluclean ™ (15.6 mg active/g) | 0 | 0 | 0 | 0 | 0.1 | 0.1 |
| Sodium Percarbonate | 13 | 1 | 0 | 5 | 0 | 0 |
| Sodium Perborate Monohydrate | 0 | 0 | 13 | 0 | 0 | 0 |
| TAED | 3.6 | 0 | 0 | 0 | 0 | 0 |
| (DMHP)2MnCl complex 1 | 0.1 | 0.03 | 0.06 | 0.3 | 0.1 | 0.7 |
| EDDS | 0.2 | 0.2 | 0.2 | 0.2 | 0.2 | 0.2 |
| Hydroxyethane di phosphonate (HEDP) | 0.2 | 0.2 | 0.2 | 0.2 | 0.2 | 0.2 |
| $MgSO_4$ | 0.42 | 0.42 | 0.42 | 0.42 | 0.4 | 0.4 |
| Perfume | 0.5 | 0.6 | 0.5 | 0.6 | 0.6 | 0.6 |
| Suds suppressor agglomerate | 0.05 | 0.1 | 0.05 | 0.1 | 0.06 | 0.05 |

-continued

| wt % | A | B | C | D | E | F |
|---|---|---|---|---|---|---|
| Soap | 0.45 | 0.45 | 0.45 | 0.45 | 0 | 0 |
| Sulphonated zinc phthalocyanine (active) | 0.0007 | 0.0012 | 0.0007 | 0 | 0 | 0 |
| S-ACMC | 0.01 | 0.01 | 0 | 0.01 | 0 | 0 |
| Direct Violet 9 (active) | 0 | 0 | 0.0001 | 0.0001 | 0 | 0 |
| Sulfate/Water & Miscellaneous | | | Balance | | | |

Example 4

Granular Laundry Detergent Compositions

| wt % | A | B | C | D | E | F |
|---|---|---|---|---|---|---|
| Linear alkylbenzenesulfonate | 20 | 22 | 20 | 15 | 20 | 20 |
| $C_{12-14}$ Dimethylhydroxyethyl ammonium chloride | 0.7 | 0.2 | 1 | 0.6 | 0 | 0 |
| AE3S | 0.9 | 1 | 0.9 | 0 | 0.5 | 0.9 |
| AE7 | 0 | 0 | 0 | 1 | 0 | 3 |
| Sodium tripolyphosphate | 5 | 0 | 4 | 9 | 2 | 0 |
| Zeolite A | 0 | 1 | 0 | 1 | 4 | 1 |
| 1.6R Silicate ($SiO_2$:$Na_2O$ at ratio 1.6:1) | 7 | 5 | 2 | 3 | 3 | 5 |
| Sodium carbonate | 25 | 20 | 25 | 17 | 18 | 19 |
| Polyacrylate MW 4500 | 1 | 0.6 | 1 | 1 | 1.5 | 1 |
| Random graft copolymer[1] | 0.1 | 0.2 | 0 | 0 | 0 | 0 |
| Carboxymethyl cellulose | 1 | 0.3 | 1 | 1 | 1 | 1 |
| Stainzyme ® (20 mg active/g) | 0.1 | 0.2 | 0.1 | 0.2 | 0.1 | 0.1 |
| Protease (Savinase ®, 32.89 mg active/g) | 0.1 | 0.1 | 0.1 | 0.1 | | 0.1 |
| Amylase—Natalase ® (8.65 mg active/g) | 0.1 | 0 | 0.1 | 0 | 0.1 | 0.1 |
| Lipase—Lipex ® (18 mg active/g) | 0.03 | 0.07 | 0.3 | 0.1 | 0.07 | 0.4 |
| Fluorescent Brightener | 0.16 | 0.06 | 0.16 | 0.18 | 0.16 | 0.16 |
| DTPA | 0.6 | 0.8 | 0.6 | 0.25 | 0.6 | 0.6 |
| $MgSO_4$ | 1 | 1 | 1 | 0.5 | 1 | 1 |
| Oxone ® | 0 | 0 | 0 | 1.2 | 0.5 | 0 |
| Sodium Percarbonate | 4.4 | 0 | 0.09 | 0 | 0 | 0 |
| NOBS | 1.9 | 1.2 | 0 | 0 | 0 | 0 |
| TAED | 0.58 | 0 | 0 | 0 | 0 | 0 |
| (DMHP)2MnCl complex 1 | 0.06 | 0.11 | 0.03 | 0.3 | 0.06 | 0.08 |
| DMHP (free ligand) | 0.12 | 0.005 | 0 | 0 | 0 | 0 |
| Sulphonated zinc phthalocyanine | 0.0030 | 0 | 0.0012 | 0.0030 | 0.0021 | 0 |
| S-ACMC | 0.1 | 0 | 0 | 0 | 0.06 | 0 |
| Direct Violet 9 | 0 | 0 | 0.0003 | 0.0005 | 0.0003 | 0 |
| Acid Blue 29 | 0 | 0 | 0 | 0 | 0 | 0.0003 |
| Sulfate/Moisture | | | Balance | | | |

Example 5

Heavy Duty Liquid Laundry Detergent Compositions

| wt % | A | B | C | D | E | F |
|---|---|---|---|---|---|---|
| AES $C_{12-15}$ alkyl ethoxy (1.8) sulfate | 11 | 10 | 4 | 6.32 | 0 | 0 |
| AE3S | 0 | 0 | 0 | 0 | 2.4 | 0 |
| Linear alkyl benzene sulfonate | 1.4 | 4 | 8 | 3.3 | 5 | 8 |
| HSAS | 3 | 5.1 | 3 | 0 | 0 | 0 |
| Sodium formate | 1.6 | 0.09 | 1.2 | 0.04 | 1.6 | 1.2 |
| Sodium hydroxide | 2.3 | 3.8 | 1.7 | 1.9 | 1.7 | 2.5 |
| Monoethanolamine | 1.4 | 1.49 | 1.0 | 0.7 | 0 | 0 |
| Diethylene glycol | 5.5 | 0 | 4.1 | 0 | 0 | 0 |
| AE9 | 0.4 | 0.6 | 0.3 | 0.3 | 0 | 0 |
| AE7 | 0 | 0 | 0 | 0 | 2.4 | 6 |
| Chelant | 0.15 | 0.15 | 0.11 | 0.07 | 0.5 | 0.11 |
| Citric Acid | 2.5 | 3.96 | 1.88 | 1.98 | 0.9 | 2.5 |
| $C_{12-14}$ dimethyl Amine Oxide | 0.3 | 0.73 | 0.23 | 0.37 | 0 | 0 |
| $C_{12-18}$ Fatty Acid | 0.8 | 1.9 | 0.6 | 0.99 | 1.2 | 0 |
| 4-formyl-phenylboronic acid | 0 | 0 | 0 | 0 | 0.05 | 0.02 |
| Borax | 1.43 | 1.5 | 1.1 | 0.75 | 0 | 1.07 |
| Ethanol | 1.54 | 1.77 | 1.15 | 0.89 | 0 | 3 |
| (DMHP)2MnCl complex 1 | 0.03 | 0 | 0 | 0.3 | 0.15 | 2 |

-continued

| wt % | A | B | C | D | E | F |
|---|---|---|---|---|---|---|
| DMHP (free ligand) | 0.12 | 0.1 | 2 | 0 | 0 | 0 |
| Ethoxylated ($EO_{15}$) tetraethylene pentamine | 0.3 | 0.33 | 0.23 | 0.17 | 0 | 0 |
| Ethoxylated hexamethylene diamine | 0.8 | 0.81 | 0.6 | 0.4 | 1 | 1 |
| 1,2-Propanediol | 0 | 6.6 | 0 | 3.3 | 0.5 | 2 |
| Protease (40.6 mg active/g) | 0.8 | 0.6 | 0.7 | 0.9 | 0.7 | 0.6 |
| Mannanase: Mannaway ® (25 mg active/g) | 0.07 | 0.05 | 0.045 | 0.06 | 0.04 | 0.045 |
| Amylase: Stainzyme ® (15 mg active/g) | 0.3 | 0.2 | 0.3 | 0.1 | 0.2 | 0.4 |
| Amylase: Natalase ® (29 mg active/g) | 0 | 0.2 | 0.1 | 0.15 | 0.07 | 0 |
| Lipex ® (18 mg active/g) | 0.4 | 0.2 | 0.3 | 0.1 | 0.2 | 0 |
| (DMHP)2MnCl complex 1 | | | | | | |
| Liquitint ® Violet CT (active) | 0.006 | 0.002 | 0 | 0 | 0 | 0.002 |
| S-ACMC | — | — | 0.01 | 0.05 | 0.01 | 0.02 |
| Core Shell Melamine-formaldehyde encapsulate of perfume | 0.1 | 0 | 0 | 0 | 0.18 | 0.3 |
| Water, perfume, dyes & other components | | | Balance | | | |

Example 6

Bleach & Laundry Additive Detergent Formulations

| wt % | A | B | C | D | E | F |
|---|---|---|---|---|---|---|
| AE3S | 2.0 | 4.0 | 0 | 12.0 | 5.0 | 10.0 |
| LAS | 10.0 | 10.0 | 23.6 | 22.0 | 12.0 | 26.8 |
| HC1617HSAS | 0 | 0 | 0 | 6.5 | 3.8 | 0 |
| Nonionic C24EO9 | 0 | 0 | 0 | 0 | 3.6 | 0 |
| DTPA: Diethylene triamine pentaacetic acid | 0.51 | 0.77 | 1.5 | 0 | 0 | 2.5 |
| 4,5-Dihydroxy-1,3-benzenedisulfonic acid disodium salt | 1.82 | 0 | 0 | 0 | 0 | 2.5 |
| 1,2-propandiol | 10 | 10 | 0 | 0 | 5 | 20.0 |
| (DMHP)2MnCl complex 1 | 0.13 | 0.25 | 0.11 | 0.03 | 0.11 | 0.75 |
| Perfume | 0.1 | 0.5 | 0.7 | 0.2 | 0 | 0 |
| Water, perfume, dyes & other components | | | Balance | | | |

Example 7

A dual compartment unit-dose laundry detergent article of the present invention, encapsulated in a polyvinyl alcohol film, wherein the activated peroxygen source and the metal bleach catalyst are in separate compartments.

| Ingredient name | Compartment 1 32 g WT % | Compartment 2 7 g WT % |
|---|---|---|
| Linear alkyl benzene sulfonic acid | 10 | 14.8 |
| (DMHP)2MnCl complex 1 | — | 0.15 |
| Sodium Percarbonate | 23 | — |
| Tetraacetyl ethylene diamine (TAED) | 5 | — |
| Carbonate | 20 | — |
| C12-14 alkyl ethoxy 3 sulphate salt | 3 | 8.8 |
| C12-14 alkyl sulphate salt | 2 | — |
| C12-14 alkyl 7-ethoxylate | — | 13.0 |
| C12-18 Fatty acid | 0 | 15.0 |
| Amylase Enzyme | 2 | 2.3 |
| Protease Enzyme | 2 | 2.3 |
| Zeolite | 10 | — |
| PEG-PVAc polymer | — | 5.0 |
| Monoethanol amine | — | To pH 7.5 |
| Solvent | — | 18.6 |
| Color | — | 0.008 |
| Water | — | 9.5 |
| Miscellaneous/Minors | To 100 | To 100 |

Raw Materials and Notes for Composition Examples 1-7 Above

LAS: Linear alkylbenzenesulfonate having an average aliphatic carbon chain length $C_{11}$-$C_{12}$ supplied by Stepan, Northfield, Ill., USA $C_{12-14}$ Dimethylhydroxyethyl ammonium chloride, supplied by Clariant GmbH, Sulzbach, Germany AE3S is $C_{12-15}$ alkyl ethoxy (3) sulfate supplied by Stepan, Northfield, Ill., USA AE7 is $C_{12-15}$ alcohol ethoxylate, with an average degree of ethoxylation of 7, supplied by Huntsman, Salt Lake City, Utah, USA AE9 is $C_{12-13}$ alcohol ethoxylate, with an average degree of ethoxylation of 9, supplied by Huntsman, Salt Lake City, Utah, USA HSAS is a mid-branched primary alkyl sulfate with carbon chain length of about 16-17 Sodium tripolyphosphate is supplied by Rhodia, Paris, France Zeolite A is supplied by Industrial Zeolite (UK) Ltd, Grays, Essex, UK 1.6R Silicate is supplied by Koma, Nestemica, Czech Republic Sodium Carbonate is supplied by Solvay, Houston, Tex., USA Polyacrylate MW 4500 is supplied by BASF, Ludwigshafen, Germany Carboxymethyl cellulose is Finnfix® V supplied by CP Kelco, Arnhem, Netherlands Suitable chelants are, for example, diethylenetetraamine pentaacetic acid (DTPA) supplied by Dow Chemical, Midland, Mich., USA or Hydroxyethane di phosphonate (HEDP) supplied by Solutia, St Louis, Miss., USA Bagsvaerd, Denmark Savinase®, Natalase®, Stainzyme®, Lipex®, Celluclean™, Mannaway® and Whitezyme® are all products of Novozymes, Bagsvaerd, Denmark.

Protease (examples 8-13) supplied by Genencor International, Palo Alto, Calif., USA Protease (examples 14-20) described in U.S. Pat. No. 4,760,025 is supplied by Genencor International, Palo Alto, Calif., USA Fluorescent Brightener 1 is Tinopal® AMS, Fluorescent Brightener 2 is Tinopal® CBS-X, Sulphonated zinc phthalocyanine and Direct Violet 9 is Pergasol® Violet BN-Z all supplied by Ciba Specialty Chemicals, Basel, Switzerland Oxone® is 2KHSO5.KHSO4.K2SO4. The active component potassium monopersulfate (KHSO5, potassium peroxomonosulfate) is a salt from the Caro's acid H2SO5.

Sodium percarbonate supplied by Solvay, Houston, Tex., USA

Sodium perborate is supplied by Degussa, Hanau, Germany

NOBS is sodium nonanoyloxybenzenesulfonate, supplied by Future Fuels, Batesville, Ark., USA TAED is tetraacetylethylenediamine, supplied under the Peractive® brand name by Clariant GmbH, Sulzbach, Germany DMHP is 1,2-dimethyl-3-hydroxy-4(1H)-pyridinone S-ACMC is carboxymethylcellulose conjugated with C.I. Reactive Blue 19, sold by Megazyme, Wicklow, Ireland under the product name AZO-CM-CELLULOSE, product code S-ACMC.

Soil release agent is Repel-o-tex® PF, supplied by Rhodia, Paris, France

Acrylic Acid/Maleic Acid Copolymer is molecular weight 70,000 and acrylate:maleate ratio 70:30, supplied by BASF, Ludwigshafen, Germany Na salt of Ethylenediamine-N,N'-disuccinic acid, (S,S) isomer (EDDS) is supplied by Octel, Ellesmere Port, UK Hydroxyethane di phosphonate (HEDP) is supplied by Dow Chemical, Midland, Mich., USA Suds suppressor agglomerate is supplied by Dow Corning, Midland, Mich., USA HSAS is mid-branched alkyl sulfate as disclosed in U.S. Pat. No. 6,020,303 and U.S. Pat. No. 6,060,443

$C_{12-14}$ dimethyl Amine Oxide is supplied by Procter & Gamble Chemicals, Cincinnati, Ohio, USA Liquitint® Violet CT is supplied by Milliken, Spartanburg, S.C., USA The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A metal bleach catalyst complex having a structure of formula:

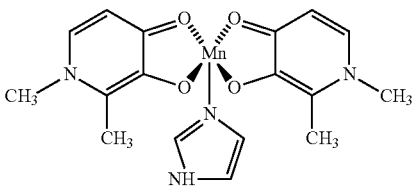

or

-continued

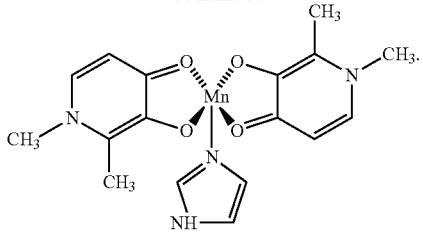

2. A metal bleach catalyst complex according to claim 1 having a structure of formula:

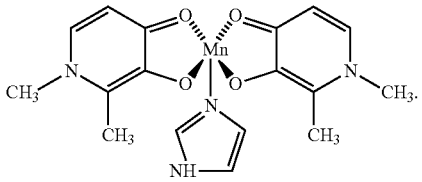

3. A metal bleach catalyst complex according to claim 1 having a structure of formula:

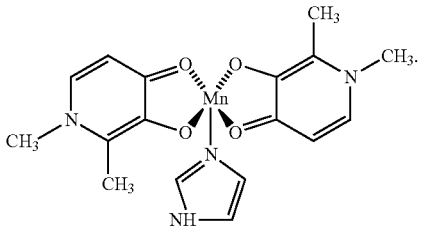

4. A composition complex having a structure of formula:

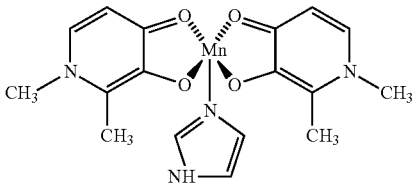

or

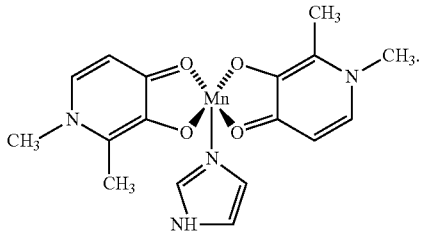

5. A composition according to claim 4, wherein the metal bleach catalyst complex has a structure of formula:

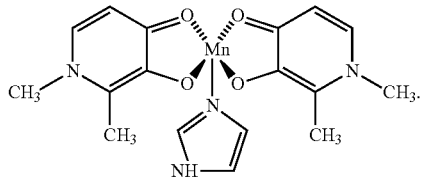

6. A composition according to claim 4, wherein the metal bleach catalyst complex has a structure of formula:

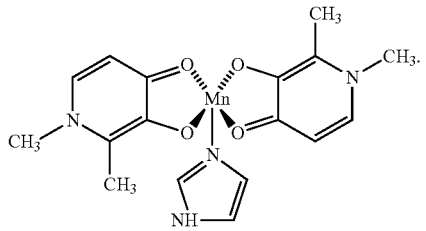

7. A composition according to claim 4, wherein said composition comprises about 0.001% to about 1% of the metal bleach catalyst complex, and further comprising at least one adjunct ingredient selected from the group consisting of: a surfactant, a builder, a chelating agent, a dye transfer inhibiting agent, a dispersant, one or more additional enzymes, an enzyme stabilizer, a catalytic material, a bleach activator, a hydrogen peroxide, a source of hydrogen peroxide, a preformed peracid, a polymeric dispersing agent, a clay soil removal/anti-redeposition agent, a brightener, a suds suppressor, a dye, a perfume, a perfume delivery system, a structure elasticizing agent, a fabric softener, a carrier, a hydrotrope, an encapsulate comprising a perfume, a hueing agent, an amphiphilic cleaning polymer, a processing aid, a solvent, a pigment and mixtures thereof.

8. A method of treating a textile, the method comprising the steps of:

(1) treating the textile with an aqueous solution of a metal bleach catalyst complex according to claim 1, the aqueous solution comprising from 1 ppb to 5 ppm of said bleach catalyst complex and from 0.1 g/L to 2 g/L of a surfactant; and (2) rinsing and drying the textile.

9. A method according to claim 8, wherein the metal bleach catalyst has a complex structure of formula:

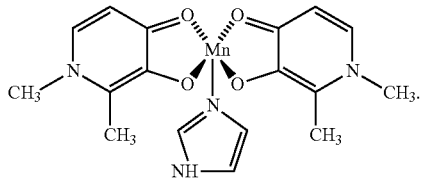

10. A method according to claim 8, wherein the metal bleach catalyst complex has a structure of formula:

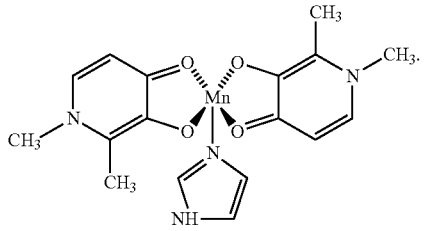

* * * * *